US006053801A

United States Patent [19]

Pinson et al.

[11] Patent Number: 6,053,801

[45] Date of Patent: Apr. 25, 2000

[54] SUBSTRATE POLISHING WITH REDUCED CONTAMINATION

[75] Inventors: Jay D. Pinson, San Jose; Nitin Shah, Fremont; David W. Groechel, Sunnyvale; Joe Waidl, San Jose, all of Calif.

[73] Assignee: Applied Materials, Inc., Santa Clara, Calif.

[21] Appl. No.: 09/309,182

[22] Filed: May 10, 1999

[51] Int. Cl.[7] ..... B24B 55/12

[52] U.S. Cl. ..... 451/56; 451/444

[58] Field of Search ..... 451/443, 444, 451/56, 41, 288

[56] References Cited

U.S. PATENT DOCUMENTS

| | | | |
|---|---|---|---|
| 5,421,768 | 6/1995 | Fujiwara et al. | 451/287 |
| 5,578,529 | 11/1996 | Mullins | 451/41 |
| 5,616,069 | 4/1997 | Walker et al. | 451/444 |
| 5,702,563 | 12/1997 | Salugsugan et al. | 451/28 |
| 5,779,522 | 7/1998 | Walker et al. | 451/444 |

FOREIGN PATENT DOCUMENTS

| | | | |
|---|---|---|---|
| 0010769 | 1/1991 | Japan | 125/11.01 |

*Primary Examiner*—Robert A. Rose
*Attorney, Agent, or Firm*—Fish & Richardson

[57] ABSTRACT

Systems and methods for polishing a substrate with reduced contamination are described. A rinse arm has one or more nozzles configured to direct rinse fluid toward a polishing surface for polishing a substrate. The rinse arm further includes a fluid dispenser configured to direct rinse fluid to one or more surfaces of the rinse arm in proximity to the polishing surface and exposed to airborne slurry particles generated from slurry on the polishing surface. By maintaining the atmosphere in the vicinity of the exposed rinse arm surfaces at an elevated relative humidity level, airborne slurry particles adhering to the exposed rinse arm surfaces remain in suspension and, therefore, may be easily cleaned, e.g., during a high pressure rinse cycle. This feature reduces the likelihood that slurry particles will accumulate on exposed surfaces of the polishing apparatus and flake off while a substrate is being polished, reducing the likelihood of substrate defects caused by such slurry contamination.

17 Claims, 5 Drawing Sheets

SUBSTRATE POLISHING WITH REDUCED CONTAMINATION

BACKGROUND OF THE INVENTION

The invention relates to substrate polishing techniques, including chemical mechanical polishing (CMP).

Chemical mechanical polishing is a process by which a substrate surface is smoothed (planarized) to a uniform level by a polishing pad and an abrasive slurry. A substrate to be polished is usually mounted on a rotatable carrier head and pressed against a moving polishing pad. The polishing pad typically includes an abrasive surface. An abrasive chemical solution (slurry) may be introduced onto the polishing pad to assist in the polishing process. Typically, a rinse arm supplies rinse fluid (e.g., de-ionized water) to the polishing pad to remove coagulated slurry and other material from the polishing pad surface.

SUMMARY OF THE INVENTION

In one aspect, the invention features systems and methods for polishing a substrate with reduced contamination. A substrate polishing system comprises: a substrate carrier; a polishing surface; and a rinse arm having one or more nozzles configured to direct rinse fluid toward the polishing surface, the rinse arm further having a fluid dispenser configured to direct rinse fluid to one or more surfaces of the rinse arm in proximity to the polishing surface and exposed to airborne slurry particles generated from slurry on the polishing surface. A substrate polishing method comprises: supporting a substrate above a polishing surface; dispensing slurry onto the polishing surface; polishing the substrate against the polishing surface; directing rinse fluid through a rinse arm toward the polishing surface; and directing rinse fluid to one or more surfaces of the rinse arm in proximity to the polishing surface and exposed to airborne slurry particles generated from slurry on the polishing surface.

Embodiments may include one or more of the following features.

The fluid dispenser may be configured to direct moist air in the vicinity of the exposed surfaces of the rinse arm. In one embodiment, the fluid dispenser comprises a nozzle. In accordance with this embodiment, the fluid dispenser is configured to receive a liquid and to direct the liquid through the nozzle to generate a fine mist in the vicinity of the one or more exposed surfaces.

In operation, the fluid dispenser may be configured to maintain the atmosphere in the vicinity of the one or more exposed surfaces at a relative humidity level of about 80% or greater. The fluid dispenser may be configured to maintain a layer of liquid on the one or more exposed surfaces.

In some embodiments, the rinse arm includes a spray shield, and the fluid dispenser is configured to direct rinse fluid to one or more exposed surfaces of the spray shield. The spray shield may have an exposed curved surface.

Rinse fluid may directed to the one or more exposed surfaces while the polishing surface is being rinsed. Rinse fluid also may be directed to the one or more exposed surfaces after the polishing surface has been rinsed. In one mode of operation, rinse fluid is directed to one or more exposed surfaces while the polishing apparatus is idle.

Among the advantages of the invention are the following. By maintaining the atmosphere in the vicinity of the exposed rinse arm surfaces at an elevated relative humidity level, airborne slurry particles adhering to the exposed surfaces remain in suspension and, therefore, may be easily cleaned, e.g., during a high pressure rinse cycle. This feature reduces the likelihood that slurry particles will accumulate on exposed surfaces of the polishing apparatus and flake off while a substrate is being polished, reducing the likelihood of substrate defects caused by such slurry contamination.

Other features and advantages will become apparent from the following description, including the drawings and the claims.

DETAILED DESCRIPTION

Figure 1A:
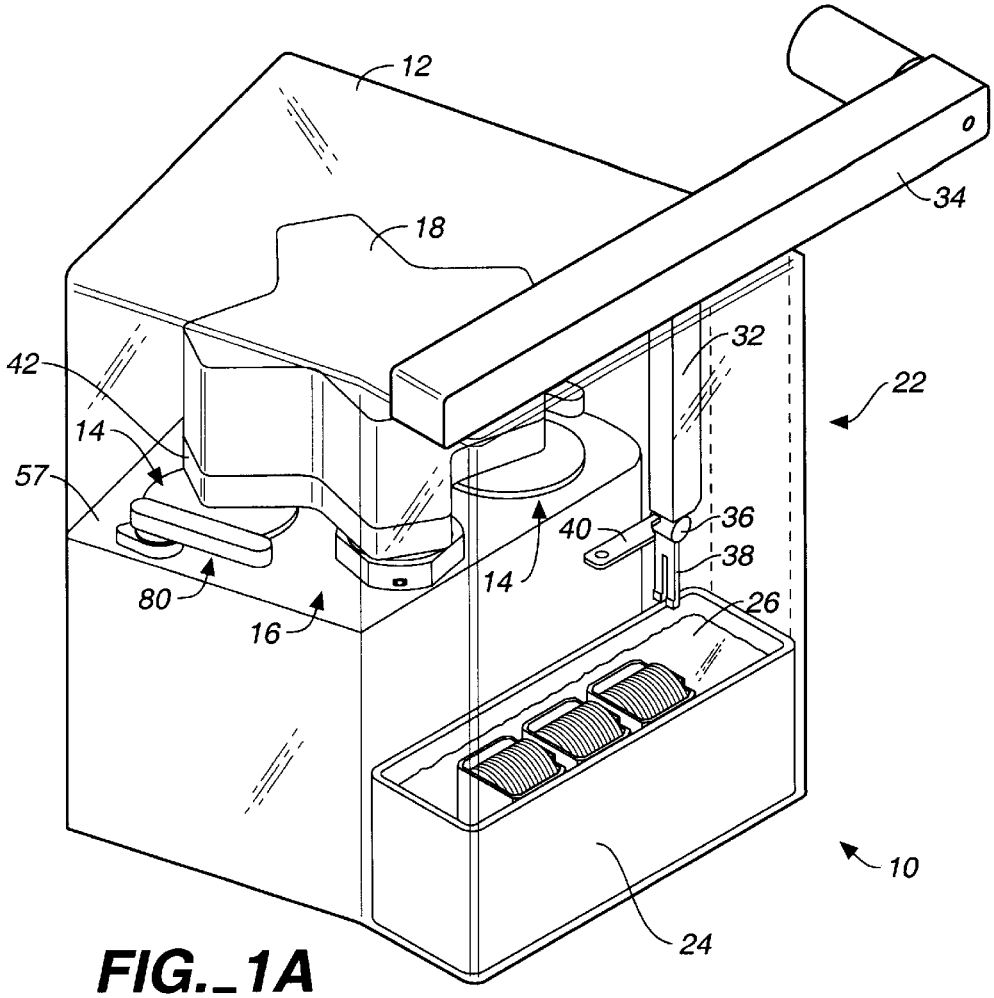
FIG. 1A is a perspective view of a polishing apparatus.
Figure 1B:
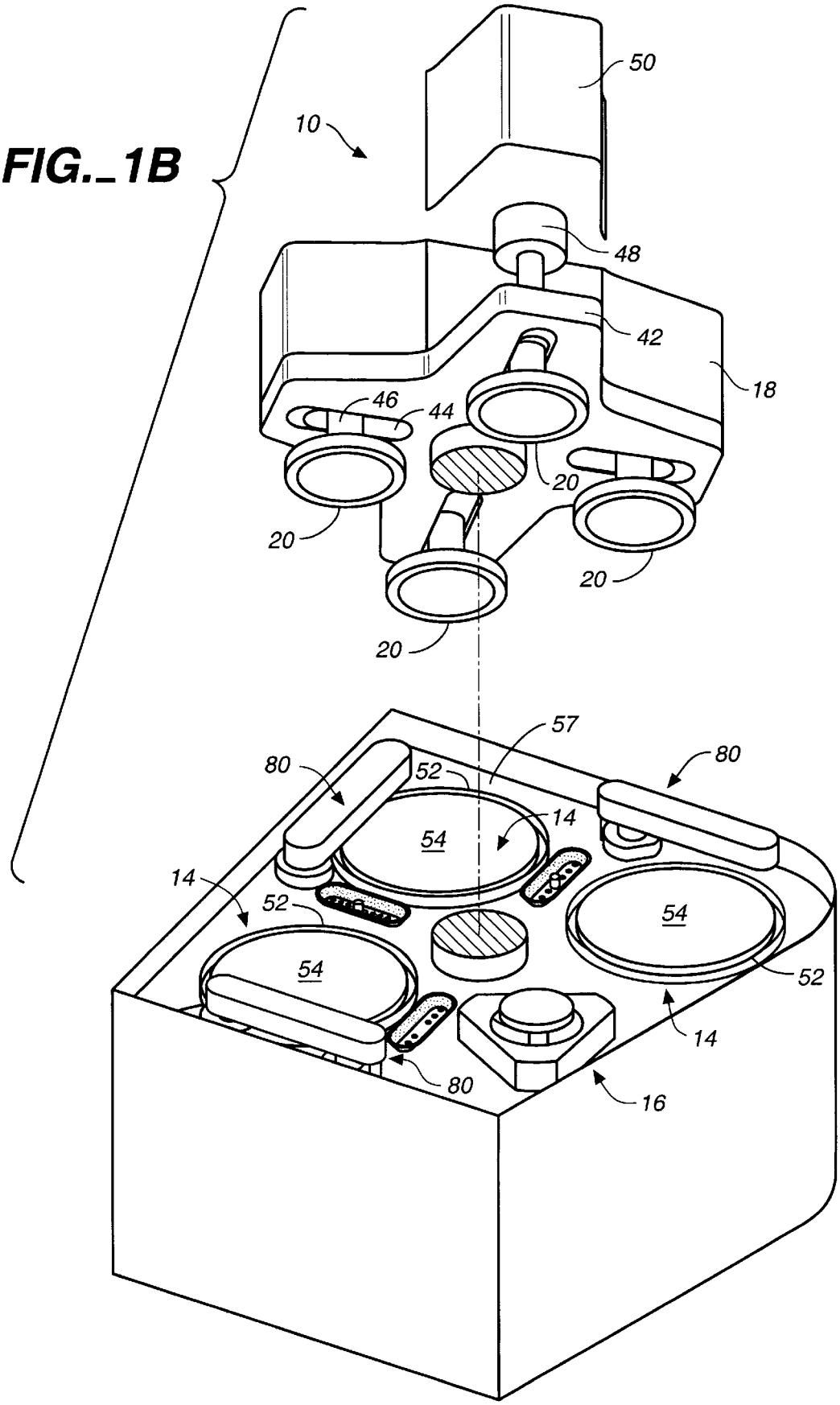
FIG. 1B is an exploded view of the polishing apparatus of FIG. 1A.
Figure 2A:
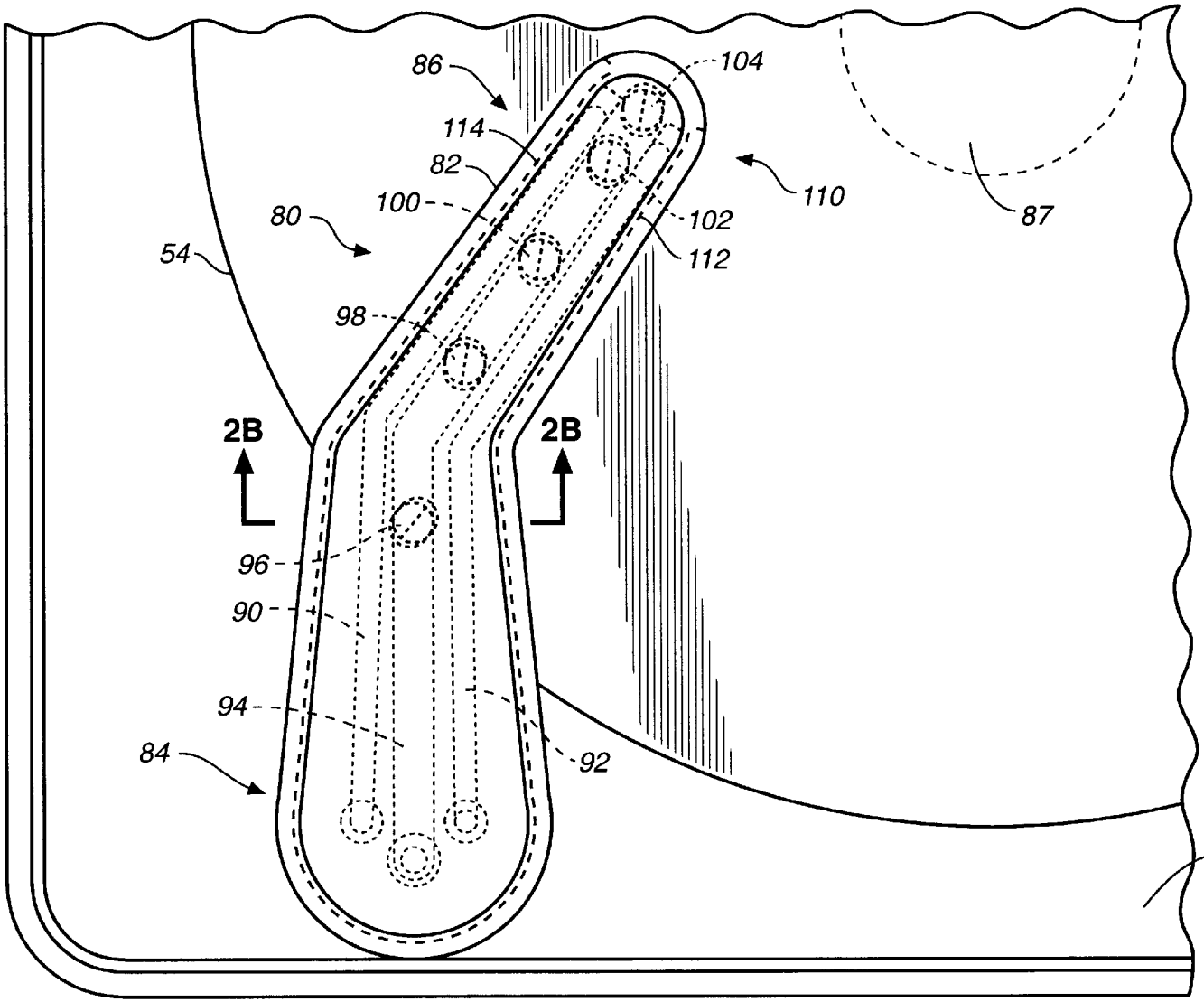
FIG. 2A is a diagrammatic top view of a fluid delivery system disposed over a polishing pad.

Referring to FIGS. 1A and 1B, a polishing apparatus 10 includes a housing 12 that contains three independently-operated polishing stations 14, a substrate transfer station 16, and a rotatable carousel 18 which choreographs the operation of four independently rotatable carrier heads 20. Attached to one side of housing 12 is a substrate loading apparatus 22 that includes a tub 24 that contains a liquid bath 26 in which cassettes 28 of substrates 30 are immersed before polishing.

Carousel 18 has a support plate 42 with slots 44 through which shafts 46 of carrier heads 20 extend. Carrier heads 20 can independently rotate and oscillate back-and-forth in slots 44 to achieve a uniformly polished substrate surface. Carrier heads 20 are rotated by respective motors 48, which are normally hidden behind removable sidewalls 50 of carousel 18. In operation, a substrate is loaded from tub 24 to transfer station 16, from which the substrate is transferred to a carrier head 20. Carousel 18 then transfers the substrate through a series of one or more polishing stations 14 and finally returns the polished substrate to transfer station 16.

Each polishing station 14 includes a rotatable platen 52, which supports a polishing pad 54, and a fluid delivery system 80. Platen 52 and fluid delivery system 80 are both mounted to a tabletop 57 of polishing apparatus 10. A pad conditioner (not shown) also may be provided to condition the surface of polishing pad 54.

For further details regarding the general features and operation of polishing apparatus 10, please refer to U.S. Pat. No. 5,738,574, by Perlov et al., entitled "Continuous Processing System for Chemical Mechanical Polishing," and assigned to the assignee of the present invention, which is incorporated herein by reference.

Referring to FIGS. 2A, 2B, 3A and 3B, fluid delivery system 80 dispenses slurry onto polishing pad 54 to assist in the polishing process and, after a substrate has been polished, fluid delivery system 80 delivers rinsing fluid to polishing pad 54 to remove slurry from the pad surface.

Fluid delivery system 80 includes a rinse arm 82 having a base portion 84 disposed outwardly from the edge of polishing pad 54 and an end portion 86 disposable over polishing pad 54. Base portion 84 is mounted on a shaft 88 to enable rinse arm 82 to rotate between a processing position over polishing pad 54 and a maintenance position adjacent to the pad. Rinse arm 82 may be angled along its length from base portion 84 to its end portion 86 (as shown), or it may be straight. Rinse arm 82 includes two slurry delivery lines 90, 92 mounted or disposed within rinse arm 82. Preferably, slurry delivery lines 90, 92 are formed from tubing which are coupled to one or more slurry sources. A diastolic or other pump may be used to pump slurry through delivery lines 90, 92.

A central rinse fluid delivery line 94 delivers one or more rinse agents to a plurality of nozzles 96, 98, 100, 102, and 104 mounted to a lower surface 106 of fluid rinse arm 82. End portion 86 preferably terminates at a position short of the center of polishing pad 54 to allow substrate carrier 20 to move radially across polishing pad 54 without the risk of collision between rinse arm 82 and substrate carrier 20. Nozzle 104 is disposed on end portion 86 of rinse arm 82 at an angle relative to the plane of rinse arm 82 so that it may deliver rinse fluid to a central region 87 of polishing pad 54. In an alternative embodiment, rinse arm 82 may extend over the center of polishing pad 54 and deliver rinse fluid to the center of the pad through a nozzle directed downwardly from end of rinse arm 82; the rinse arm is moved out of the way during polishing operations. Rinse fluid is supplied to polishing pad 54 at a pressure sufficient to remove slurry from the pad. An exemplary rinse fluid pressure range is about 15–100 psi, and preferably about 30 psi or greater.

Mounting shaft 88 houses slurry delivery lines 90, 92 (FIG. 3A) and a rinse fluid channel 108 (FIG. 3B) which delivers fluid to fluid rinse arm 82. Nozzles 96–104 are threadedly mounted in or otherwise disposed on lower surface 106 of rinse arm 82 and are connected to rinse fluid channel 94. Nozzles 96–104 are preferably fine-tipped nozzles configured to deliver rinse fluid in a fan-shaped plane to reduce splashing cause by the spray of rinse fluid against polishing pad 54. In one embodiment, nozzles 96–104 deliver rinse fluid in an overlapping pattern across the surface of polishing pad 54 to insure that a substantial portion of polishing pad 54 receives a direct spray of rinse fluid. Nozzles 96–104 deliver rinse fluid at polishing pad 54 with a volume and at a pressure selected to lift and suspend (entrain) slurry particles in the volume of rinse fluid.

Figure 2B:
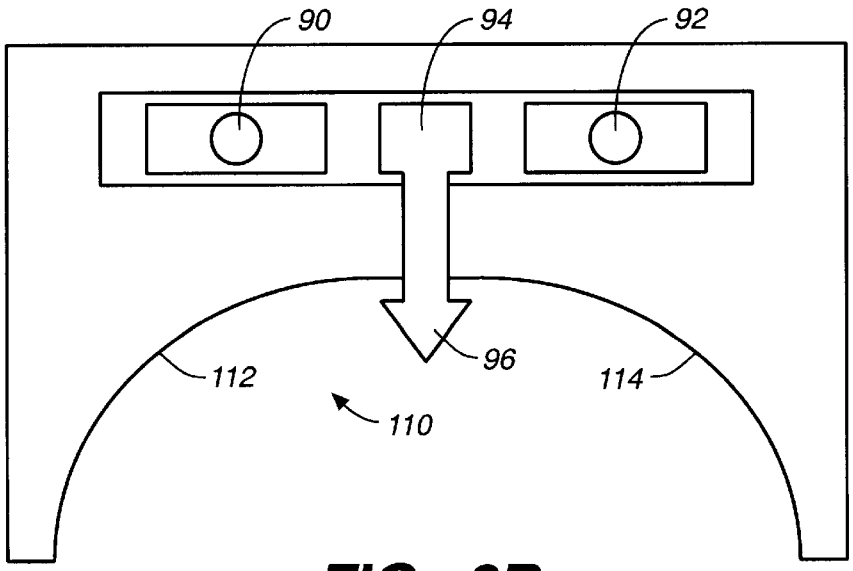
FIG. 2B is a diagrammatic cross-sectional side view of the fluid delivery system of FIG. 2A.

As shown in FIG. 2B, the rinse arm housing includes a spray shield 110 formed from two curved side walls 112, 114 that extend downwardly from lower surface 106 of rinse arm 82 toward polishing pad 54 to confine at least a portion of rinse fluid spray from nozzles 96–104. The lower edges of shield side walls 112, 114 are positioned above the surface of polishing pad 54 to allow material to pass underneath while effectively confining a substantial amount of rinse fluid. The height of the lower edges of shield walls 112, 114 above the surface of the polishing pad may be adjusted. The flow rate of rinse fluid and the distance between the lower edges of shield 110 and polishing pad 54 may be selected so that a wave of rinse fluid may accumulate and sweep away excess material from the surface of polishing pad 54. As polishing pad 54 rotates, rinse fluid and excess slurry material may be swept towards the edge of polishing pad 54 where they may be collected for disposal.

Figure 3A:
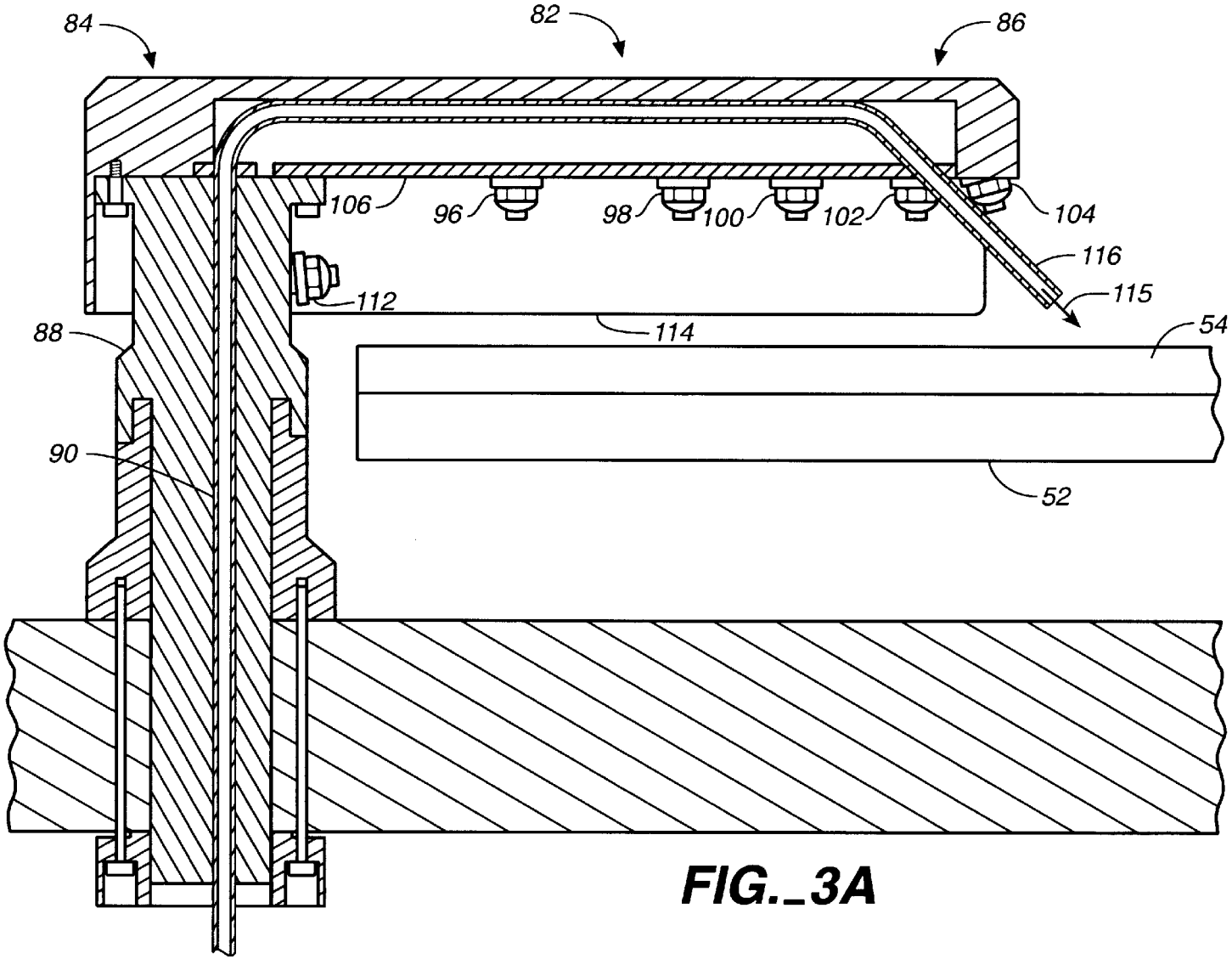
FIG. 3A is a diagrammatic side view of a fluid delivery system delivering slurry to the surface of a polishing pad.

Referring to FIG. 3A, in one mode of operation, slurry 115 is delivered to polishing pad 54 from an output 116 of slurry delivery line 90. As slurry particles—which are in a colloidal suspension—are delivered to the surface of polishing pad 54, portions of the colloidal suspension may evaporate or otherwise become airborne. Portions of the colloidal suspension may also become airborne during a high pressure rinse cycle, as rinse fluid is being delivered to the surface of polishing pad 54. This airborne substance may adhere to exposed surfaces of the rinse arm housing in proximity to polishing pad 54. Once adhered to an exposed surface, the colloidal suspension tends to dry, leaving deposits which may accumulate over time and occasionally flake off onto polishing pad 54. If such contamination becomes trapped between substrate 30 and polishing pad 54 while substrate 30 is being polished, it would likely cause a defect in the substrate surface.

Figure 3B:
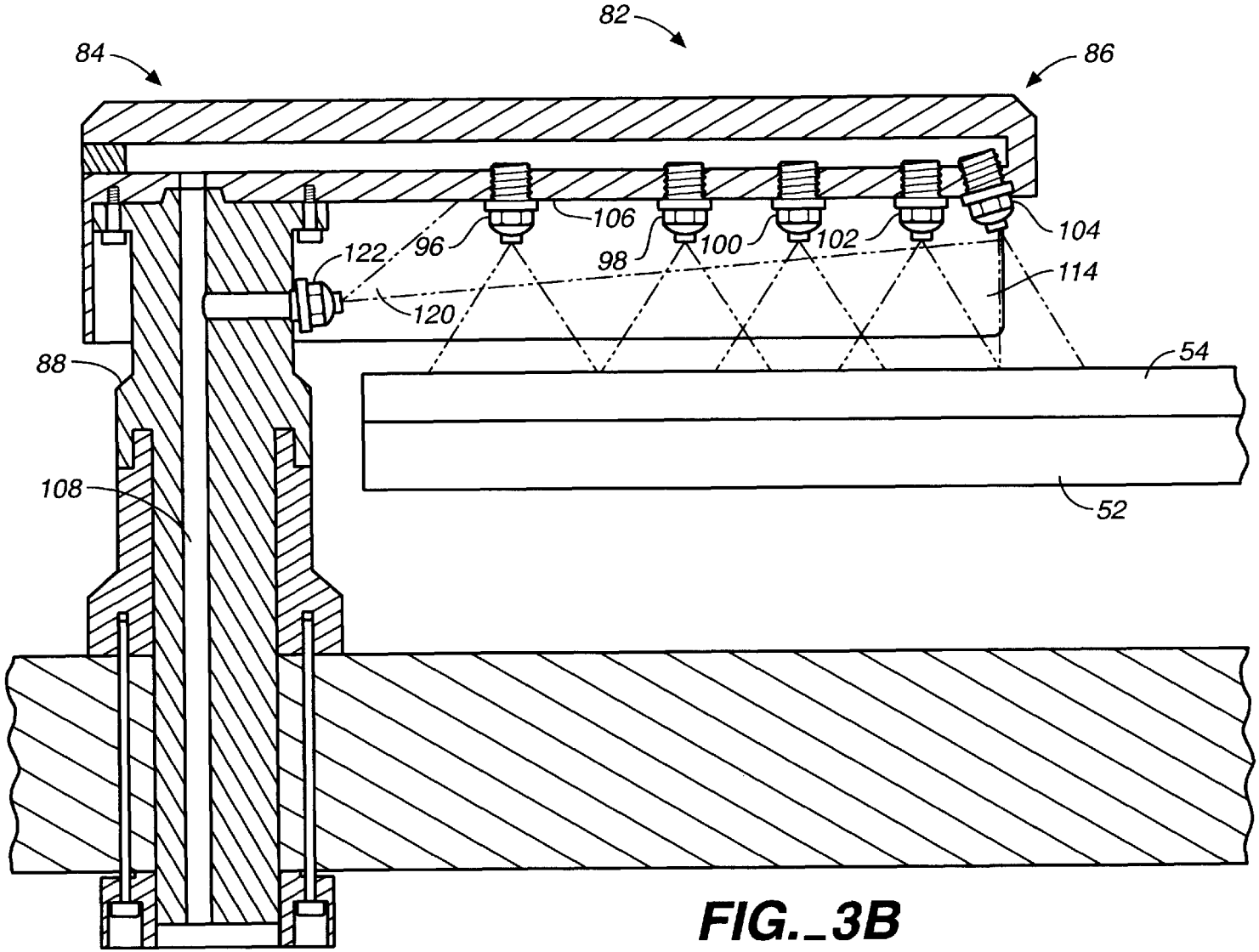
FIG. 3B is a diagrammatic side view of a fluid delivery system delivering rinse fluid to the surface of a polishing pad while moist air is being directed to rinse arm surfaces in proximity to the polishing pad and exposed to airborne slurry particles generated as the polishing pad is being rinsed.

As shown in FIG. 3B, this problem is substantially reduced by supplying moist air 120 to rinse arm surfaces in proximity to polishing pad 54 and exposed to airborne slurry particles. Moist air 120 maintains the atmosphere in the vicinity of the exposed surfaces at a relative humidity level of about 80% or greater, and preferably at a relative humidity level of about 90% or greater, up to a relative humidity level of about 99%. At these humidity levels, colloidal suspensions adhering to the exposed rinse arm surfaces do not dry and, instead, the slurry particles remain in suspension. In some modes of operation, moist air 120 maintains a layer of liquid (e.g., deionized water) on the exposed surfaces to prevent adhered colloidal suspensions from drying. In this way, deposits of slurry particles do not accumulate on the exposed rinse arm surfaces, reducing the amount of contamination that might cause substrate defects. The exposed rinse arm surfaces may be rinsed by moist air 120 while rinse solution is being applied to polishing pad 54. The exposed surface may also be rinsed by moist air 120 while polishing pad 54 is being replaced, during some other routine maintenance procedure, or while the polishing apparatus is in an otherwise idle state.

Moist air 120 may be supplied to the exposed rinse arm surfaces in proximity to polishing pad 54 in a variety of ways, including fine mist generation as described below.

As shown in FIG. 3B, rinse arm 82 includes a misting nozzle 122 configured to direct a fine fluid mist 120 in the vicinity of rinse arm surfaces in proximity to polishing pad 54 and exposed to airborne slurry particles generated as slurry is being delivered to polishing pad 54 and as slurry is being rinsed from polishing pad 54. Misting nozzle 122 directs moist air stream 120 in the vicinity of the exposed rinse arm surfaces, including lower surface 106 and the inner surfaces of shield 110, to prevent slurry deposits from accumulating on these surfaces. Misting nozzle 122 may be moved to other locations on rinse arm 82, or one or more additional misting nozzles may be installed, to provide moisture sufficient to prevent slurries from drying on the exposed surfaces of rinse arm 82.

As shown in FIG. 3B, misting nozzle 122 is coupled to rinse fluid supply line 108 so that a moist air is delivered in the vicinity of the exposed rinse arm surfaces each time rinse fluid is delivered to polishing pad 54 through nozzles 96–104. In an another embodiment, misting nozzle 122 may be coupled to a valve and a controller (not shown) that is configured to choreograph the delivery of rinse fluid through nozzle 122. In one mode of operation, misting nozzle 122 supplies moist air 120 to the exposed rinse arm surfaces after slurry has been deposited onto polishing pad 54 and rinse arm 82 has been rotated to its maintenance position adjacent to polishing pad 54. In another mode of operation, nozzle 122 supplies rinse fluid to the exposed rinse arm surfaces while polishing apparatus 10 is idle. The controller is preferably programmable to enable operators to select the times during which nozzle 122 is supplying moist air 120 to the exposed rinse arm surfaces.

Although a rotating polishing system has been described above, the invention also may be implemented in connection with a linear polishing system, such as the linear polishing system described in U.S. application Ser. No. 08/568,188, filed Dec. 5, 1995, and entitled "Substrate Belt Polisher," which is incorporated herein by reference.

Other embodiments are within the scope of the claims.

What is claimed is:

1. A substrate polishing system, comprising:

a substrate carrier;

a polishing surface; and a rinse arm having one or more nozzles configured to direct rinse fluid toward the polishing surface, the rinse arm further having a fluid dispenser configured to direct rinse fluid to one or more surfaces of the rinse arm in proximity to the polishing surface and exposed to airborne slurry particles generated from slurry on the polishing surface.

2. The system of claim 1, wherein the fluid dispenser is configured to direct moist air in the vicinity of the exposed surfaces of the rinse arm.

3. The system of claim 1, wherein the fluid dispenser comprises a nozzle.

4. The system of claim 3, wherein the fluid dispenser is configured to receive a liquid and to direct the liquid through the nozzle to generate a fine mist in the vicinity of the one or more exposed surfaces.

5. The system of claim 1, wherein, in operation, the fluid dispenser is configured to maintain the atmosphere in the vicinity of the one or more exposed surfaces at a relative humidity level of about 80% or greater.

6. The system of claim 1, wherein, in operation, the fluid dispenser is configured to maintain a layer of liquid on the one or more exposed surfaces.

7. The system of claim 1, wherein the rinse arm includes a spray shield, and the fluid dispenser is configured to direct rinse fluid to one or more exposed surfaces of the spray shield.

8. The system of claim 7, wherein the spray shield has an exposed curved surface.

9. A substrate polishing method, comprising:

supporting a substrate above a polishing surface;

dispensing slurry onto the polishing surface;

polishing the substrate against the polishing surface;

directing rinse fluid through a rinse arm toward the polishing surface; and directing rinse fluid to one or more surfaces of the rinse arm in proximity to the polishing surface and exposed to airborne slurry particles generated from slurry on the polishing surface.

10. The method of claim 9, wherein the step of directing rinse fluid toward one or more exposed surfaces of the rinse arm comprises directing moist air in the vicinity of the exposed surfaces of the rinse arm.

11. The method of claim 9, wherein the step of directing rinse fluid toward one or more exposed surfaces of the rinse arm comprises generating moist air with a fine mist nozzle.

12. The method of claim 9, wherein the step of directing rinse fluid toward one or more exposed surfaces of the rinse arm comprises maintaining the atmosphere in the vicinity of the one or more exposed surfaces at a relative humidity level of about 80% or greater.

13. The method of claim 9, wherein the step of directing rinse fluid toward one or more exposed surfaces of the rinse arm comprises maintaining a layer of liquid on the one or more exposed surfaces.

14. The method of claim 9, wherein rinse fluid is directed to the one or more exposed surfaces while the polishing surface is being rinsed.

15. The method of claim 9, wherein rinse fluid is directed to the one or more exposed surfaces after the polishing surface has been rinsed.

16. The method of claim 9, wherein the substrate is polished by a polishing apparatus, and rinse fluid is directed to one or more exposed surfaces while the polishing apparatus is idle.

17. The method of claim 9, wherein the rinse arm includes a spray shield, and rinse fluid is directed to one or more exposed surfaces of the spray shield.

* * * * *